US005170843A

United States Patent [19]

Taylor

[11] Patent Number: 5,170,843

[45] Date of Patent: Dec. 15, 1992

[54] HYDRO-RECOCKING DOWN JAR MECHANISM

[76] Inventor: William T. Taylor, 1412 Cottage Dr., Houma, La. 70360

[21] Appl. No.: 754,567

[22] Filed: Sep. 4, 1991

Related U.S. Application Data

[63] Continuation-in-part of Ser. No. 625,113, Dec. 10, 1990, Pat. No. 5,069,282.

[51] Int. Cl.[5] ..... E21B 31/113

[52] U.S. Cl. ..... 166/301; 166/178

[58] Field of Search ..... 166/301, 178; 175/296, 175/297

[56] References Cited

U.S. PATENT DOCUMENTS 4,098,338 7/1978 Perkins ..... 166/301
4,658,901 4/1987 Alexander ..... 166/301
4,736,797 4/1988 Restarick, Jr. et al. ..... 166/301
5,007,479 4/1991 Pleasants et al. ..... 166/301 X
5,069,282 12/1991 Taylor ..... 166/301

*Primary Examiner*—Thuy M. Bui

[57] ABSTRACT

A mechanical down jar and method for its use in releasing stuck objects within a well bore and for conducting other downhole servicing operations. The mechanical down jar mechanism incorporates a tubular body having fixed anvils and telescoping mandrels at each end, the lower of which is connected to the stuck object. An internal load spring is released upon application of predetermined downward force to the housing by a firing lug and firing ring release mechanism having an adjustable release force. When released the lower anvil of the housing is rapidly moved downwardly by the force of the load spring and impacts with significant force against the force transmitting sub of the lower mandrel thus transmitting downwardly directed shock force to the stuck object.

10 Claims, 6 Drawing Sheets

FIG. 12
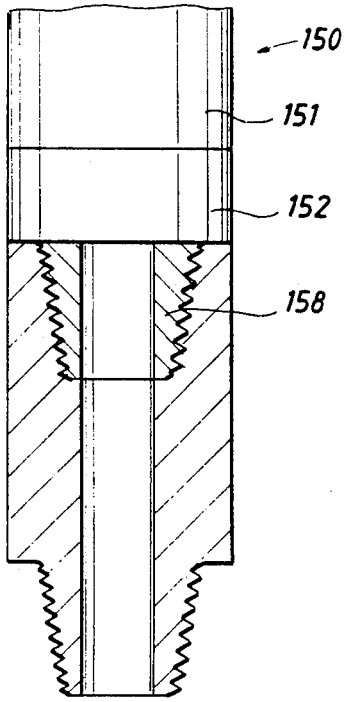
FIG. 13
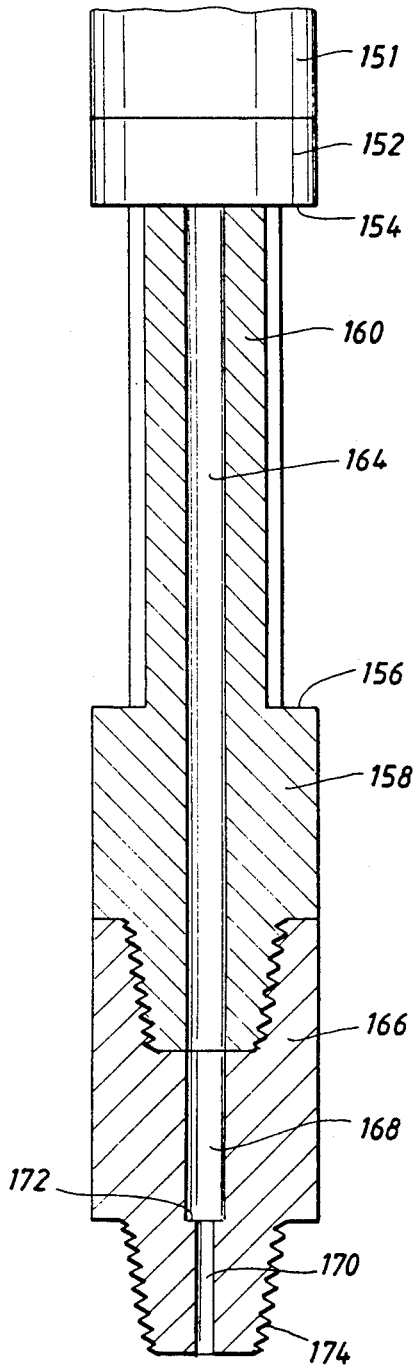
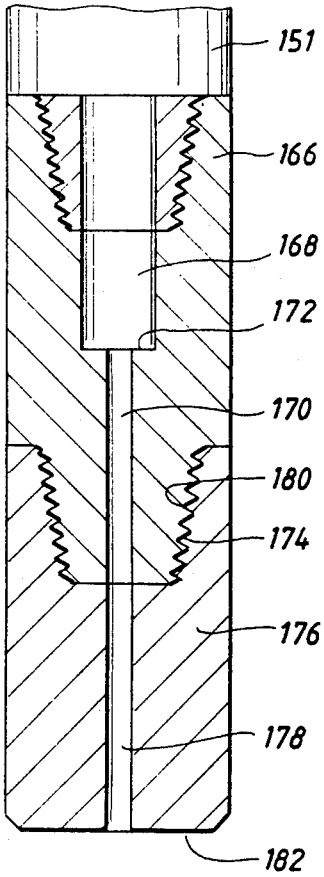
FIG. 14

HYDRO-RECOCKING DOWN JAR MECHANISM

This is a Continuation-In-Part of application Ser. No. 07/625,113, filed on Dec. 10, 1990 now U.S. Pat. No. 5,069,282 by William T. Taylor and entitled MECHANICAL DOWN JAR MECHANISM.

FIELD OF THE INVENTION

This invention relates generally to jarring mechanisms for use in well drilling and well servicing operations and more particularly concerns a hydraulic recocking mechanical down jar mechanism that is especially suitable for jarring activities in connection with coil tubing though it is quite acceptable for other down jarring activities and for use in combination with devices achieving upward jarring activities as well.

BACKGROUND OF THE INVENTION

Although the present invention is discussed herein, particularly as it relates to down jarring activities in connection with coil tubing, it should be born in mind that this jarring mechanism is also capable of efficient use in connection with conventional jointed tubing for jarring activities. Further, the telescoping components of this down jar mechanism may be provided with splined interconnection so as to be efficiently used for snubbing or drilling activities and it may be used to release locking mandrels, broaching tools shear pins etc. It may also be employed in combination with an up jarring mechanism or with an accelerator to enhance jarring activities. This jarring mechanism may also be employed for fishing activities, wherein objects that are stuck within the well bore (fish) are released by jarring activities so that they can be removed from the well.

Coil tubing fishing is becoming very popular with the oil industry due to the speed of getting the tubing into and out of the well bore, plus its ability to pull and circulate with high pressure, such as for cleaning the top of a fish to facilitate a fishing operation. It is desirable, therefore, to provide a mechanical down jarring mechanism that is capable of functioning to achieve jarring activities that re especially suitable for coil tubing to overcome the friction forces that often cause sticking of tubing that is being run into a well. It is also desirable to provide a jarring mechanism that functions efficiently during horizontal drilling activities to release stuck drill pipe and to provide downhole forces for movement of pipe in the horizontal portion of a well bore such as during operation of a mud motor for drilling. This invention is also effective for work-over activities for petroleum wells to position well service tools, release downhole tools and to provide other servicing functions.

It is well known that fishing activities are exceedingly difficult where coil tubing is involved. In approximately 50% of the cases, it is impossible where coil tubing is being employed to release the fishing tools due to the inability to develop a downwardly directed jarring or shock load on the fishing tool to release it from the fish. Coil tubing units are hydraulically controlled and cannot move downward with adequate motion to generate a shock load to fishing tools. All fishing tools, after having been jarred on for some time with upwardly directed jarring force, require downward shock impact for releasing. Jarring down is also necessary to free the fish from the fishing tool. Thus a recockable down jar mechanism is essential to effective well servicing operations.

The inventor of the subject matter hereof is considered the leader or pioneer in the industry to introduce vertical release and catch, on/off fishing tools for the purpose of coil tubing fishing. These technological advancements in fishing tools and fishing technology are considered especially important because coil tubing can not be rotated for the reason that it will twist off. In order to complete the technology to accomplish downward fishing operations with coil tubing, it becomes very necessary to develop a down jar to complete the fishing string in order to release fishing tools should the operator be unable to retrieve the fish.

Until now, the operator of the fishing equipment, in order to disengage coil tubing from fishing tools, will pump a steel ball down the coil tubing to actuate a tool release mechanism. After this has been done, the operator will then install wireline fishing equipment and enter the well with spang or tubular jars to release the fishing tool. These necessary activities become a great hindrance to the commercial success of fishing operations because of the time and expense that is involved.

Mechanical recockable down jar mechanisms have been developed, the latest of such being presented in Applicant's co-pending application identified above. Though down jars having mechanical recocking mechanisms are being utilized, it is considered desirable to provide a down jar mechanism that is designed for hydraulic recocking to facilitate sequential recocking and firing of the down jar mechanism even when a fish or other downhole object is not coupled to it. In the alternative the down jar mechanism may provide for both hydraulic and mechanical recocking, thus providing a degree of operational redundancy for commercial effectiveness.

SUMMARY OF THE INVENTION

It is a principal feature of the present invention therefore, to provide a novel hydraulic recocking mechanical down jar mechanism that is capable of functioning efficiently to achieve down jarring activities when coil tubing is being utilized for fishing operations in wells or is being employed in connection with horizontal drilling activities and workover operations.

It is another feature of this invention to provide a novel hydraulic recocking mechanical down jar mechanism designed particularly for coil tubing and which is also capable of being efficiently utilized for other down jarring activities when coil tubing is not being employed.

It is also a feature of this invention to provide a novel hydraulic recocking mechanical down jar mechanism that is capable of being utilized in connection with other jarring activities, such as with up jars, or with other mechanical devices such as accelerators, well drilling equipment, etc.

It is another feature of this invention to provide a novel down jar mechanism that provides for both hydraulic and mechanical recocking for operational redundancy.

Other and further features of this invention will become apparent to one skilled in the art upon an understanding of the preferred embodiment set forth in detail hereinbelow.

Briefly, according to the present invention, a hydraulic recocking down jar mechanism is provided having a housing having a mandrel and top sub for connection with the jar operation mechanism of the drilling or workover rig. From the bottom of the housing projects another telescoping mandrel having a bottom sub that is adapted for connection to a fishing tool or to other downhole equipment as desired. The down jar mechanism may also be connected in tandem with another down jar mechanism so as to provide an accelerator like activity during down jarring as appropriate to the job being undertaken.

Within the housing is located a load spring assembly employing Belleville springs or any other suitable springs to provide the spring load of the jar. To achieve selective release of the housing to permit sudden downward movement of the housing by the load spring assembly to achieve sudden jarring against the bottom sub and the object to which it is connected, the housing incorporates a detent body having spaced internal firing and recocking grooves formed in the internal cylindrical surface of the detent body and with a firing lug positioning land disposed between the firing and recocking grooves. The position of the detent body is adjustable linearly within the housing so as to control the release force of the firing mechanism and thus the jarring load of the jar mechanism. Internally of the detent body is provided a firing lug assembly and a firing ring which cooperate to release the load of the jar by releasing the spring assembly for expansion when the preset releasing or firing force has been exceeded. The housing further incorporates a recocking spring for recocking of the firing mechanism after firing has occurred. The down jar apparatus is also designed to provide for hydraulic recocking by fluid pressure such as by pumped fluid provided by a surface pump. The mechanical recocking spring may be eliminated or may be employed in redundant manner with the hydraulic recocking feature. The down jar mechanism is capable of being repeatedly fired to achieve repeated down jarring of the fish or other object without encountering any excessive wear of the various components thereof.

Although the drawings set forth illustrate a preferred embodiment of the down jar mechanism that is designed for down jarring and linear pulling only, it should be born in mind that the present invention may be equally well incorporated for down jarring activities and for application of rotational force. For example, the housing and mandrel may incorporate a splined interconnection as shown by the alternative embodiment hereof, thereby facilitating application of rotary force so that the jar mechanism may be suited for snubbing or drilling activities.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

In the drawings:

FIG. 1A is a sectional view of the upper portion of a mechanical down jar mechanism that is constructed in accordance with the teachings of the present invention.

FIG. 1B is a sectional view of the intermediate portion of the down jar mechanism of FIG. 1A.

FIG. 1C is a sectional view of the lower portion of the mechanical down jar mechanism of FIGS. 1A and 1B.

FIG. 2A is a sectional view of the upper portion of the down jar mechanism of FIGS. 1A, 1B, and 1C with the mechanism being shown in its fired position.

FIG. 2B is a sectional view of the intermediate portion of the down jar mechanism of FIG. 2A.

FIG. 2C is a sectional view of the lower portion of the down jar mechanism illustrating the components thereof in the "fired" condition.

FIG. 3 is a sectional view taken along line 3—3 of FIG. 2B and illustrating the detent body adjustment in detail.

FIG. 4 is a sectional view taken along line 4—4 of FIG. 2B and illustrating the firing lug mechanism in detail.

FIG. 5 is a sectional view taken along line 5—5 of FIG. 2B and illustrating the structure of the firing ring.

FIG. 6 is a fragmentary sectional view of a lower portion of a mechanical down jar mechanism representing an alternative embodiment of this invention and incorporating splined connections between the housing and telescoping upper and lower mandrels thereof.

FIG. 7 is a sectional view taken along line 7—7 of FIG. 6.

Figure 8:
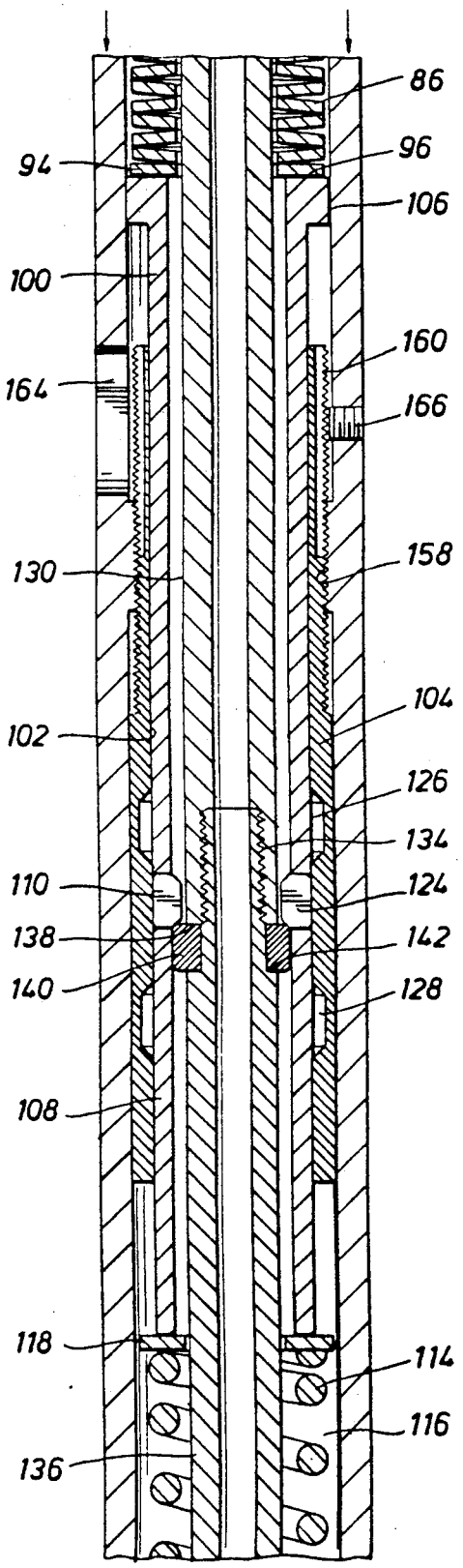

FIG. 8 is a partial sectional view illustrating the intermediate portion of the down jar mechanism with the components thereof being illustrated in the cocked position.

Figure 9:
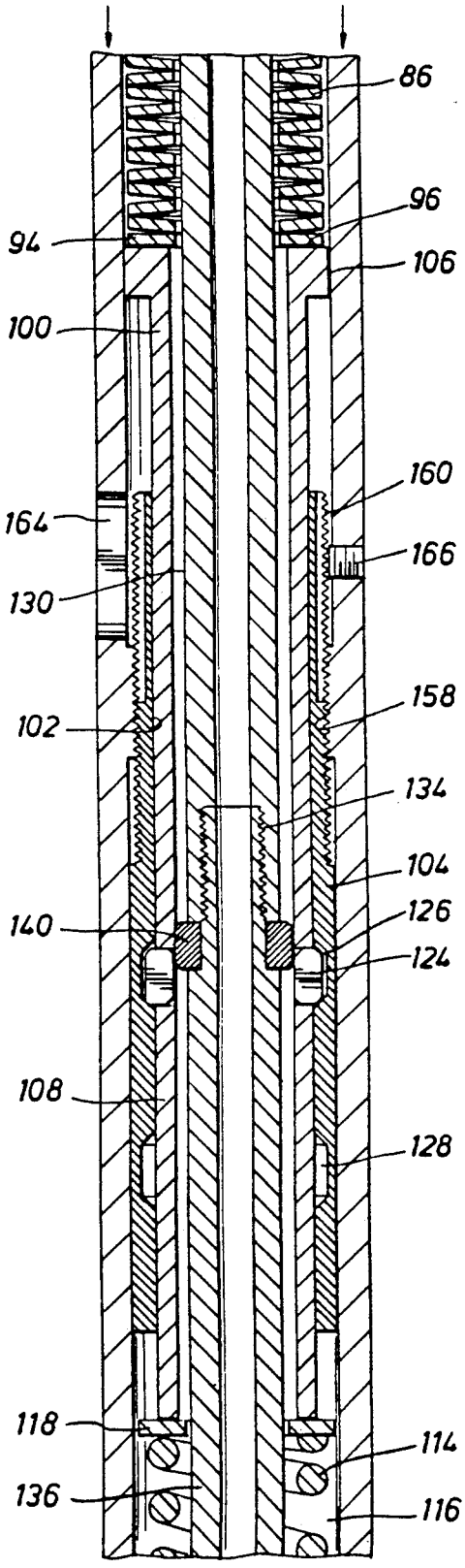

FIG. 9 is a partial sectional view similar to that of FIG. 8 and showing the components of the down jar mechanism in the released or firing position.

Figure 10:
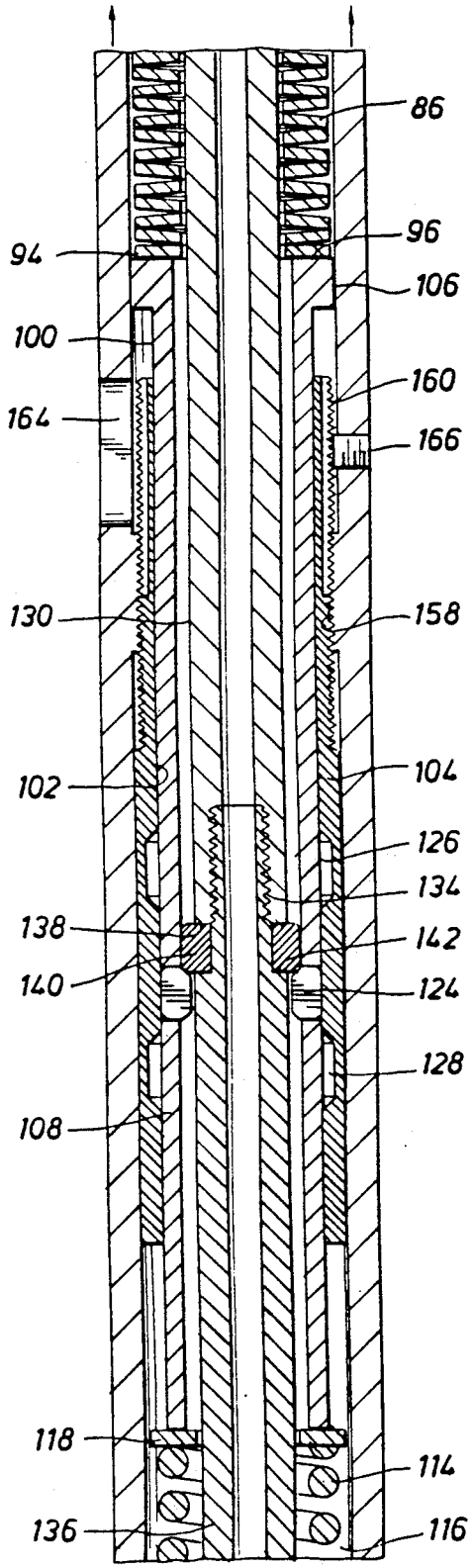

FIG. 10 is a partial sectional view similar to that of FIGS. 8 and 9 and illustrating the components of the down jar mechanism during recocking activity with force being applied in the upward direction on the outer housing.

Figure 11:
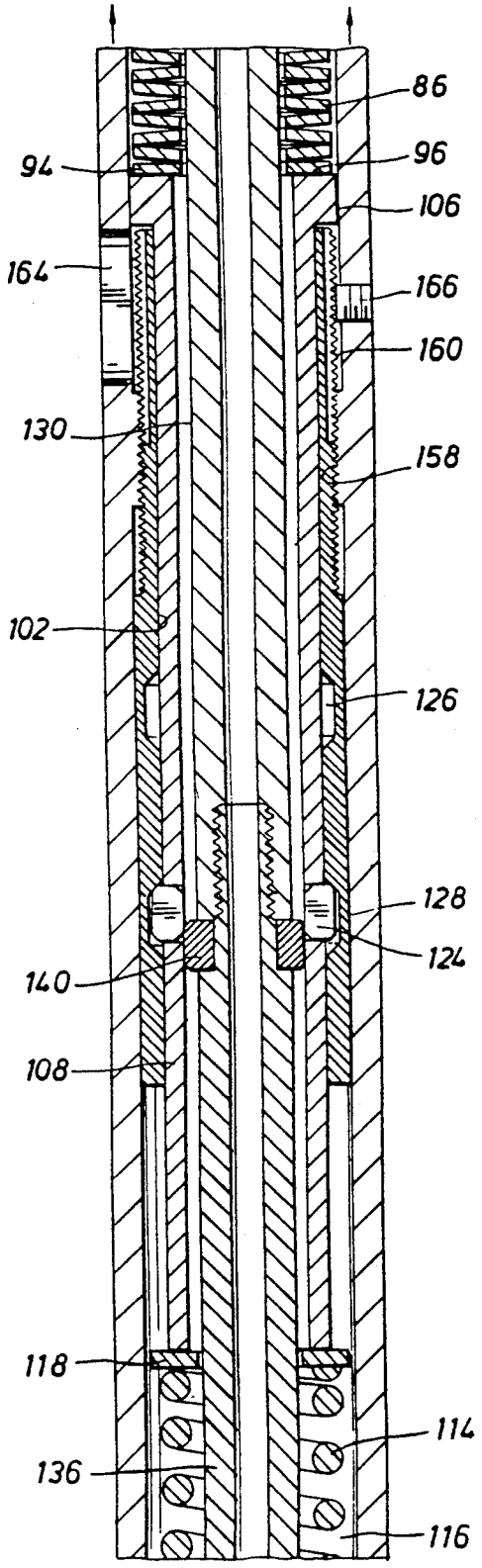

FIG. 11 is a partial sectional view similar to that of FIG. 10 and illustrating the components of the down jar mechanism at the recocked position thereof prior to application of a downwardly directed force that releases the load spring for down jarring.

FIG. 12 is a partial sectional view of a hydraulic recocking down jar constructed in accordance with the present invention and having a hydraulic recocking sub connected thereto, the assembly being shown in the fired position.

FIG. 13 is a sectional view similar to that of FIG. 8 and showing the down jar mechanism in its cocked position, being ready to fire and generate a downwardly directed jarring force.

FIG. 14 is a sectional view of a hydraulic recocking down jar constructed in accordance with the present invention and having a blind box at its lower end for imparting a downwardly directed jarring force to a stuck object.

DETAILED DESCRIPTION OF PREFERRED EMBODIMENT

Figure 1A:
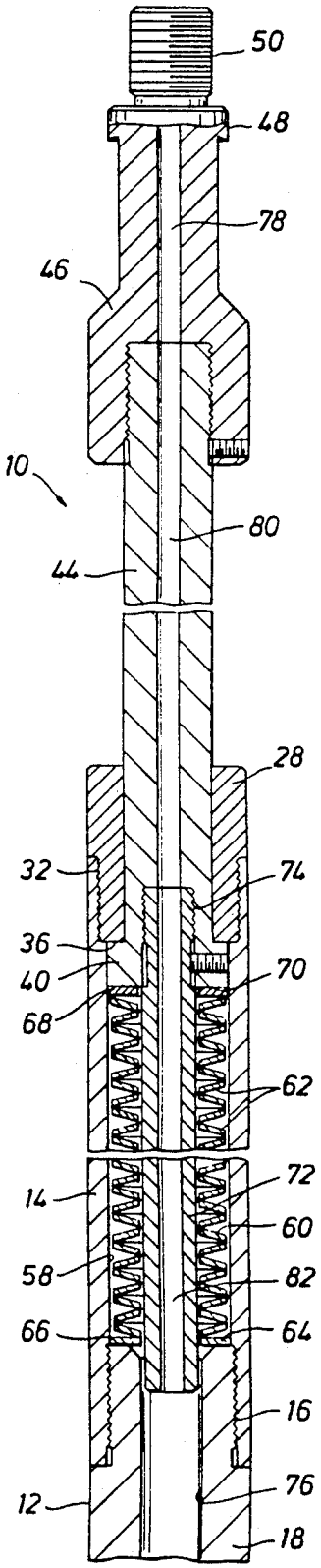
Figure 1B:
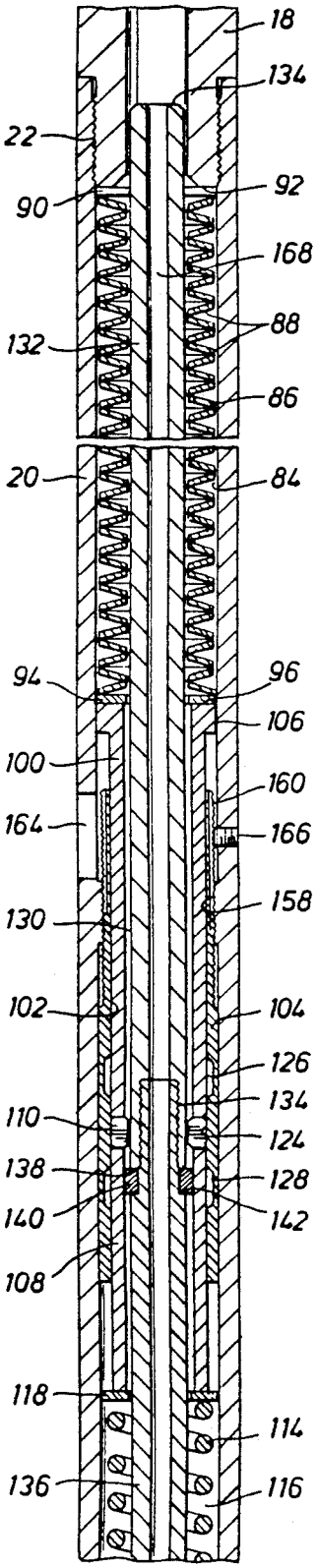
Figure 1C:
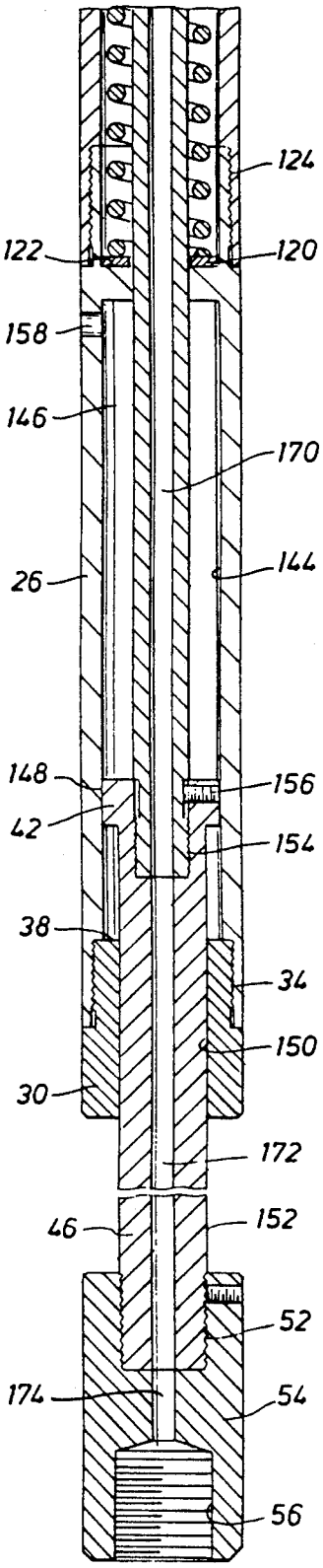

Referring now to the drawings and first to FIGS. 1A, 1B and 1C, a mechanical down jar mechanism constructed in accordance with the present invention is illustrated generally at 10 and incorporates an elongate tubular housing shown generally at 12 which is formed by an upper housing section 14 having threaded connection at 16 with a housing spacer 18. The housing further incorporates an intermediate housing section 20 having a threaded connection at 22 with the housing spacer 18 and having at its lower end, a threaded connection at 24 with a lower housing section 26. The respective upper and lower ends of the housing 12 are formed respectively by upper and lower anvil caps 28 and 30 having threaded connection respectively at 32 with the upper housing section 14 and at 34 with the lower housing section 26. The anvil caps each define inwardly directed force transmission shoulders 36 and 38 respectively for impact by impact hammers 40 and 42 which are defined by enlargements at the inner extremities of upper and lower telescoping mandrels 44 and 46. To the upper mandrel 44 is threadedly secured a top sub 46 having a fishing neck 48 formed thereby. The top sub also incorporates a threaded connection 50 that may be utilized to attach the upper mandrel to any suitable force transmitting tool, including another similar or identical down jar if required. The lower mandrel 46 is threadedly connected at 52 with a bottom sub 54 which defines an internally threaded downwardly opening receptacle 56 for establishing threaded connection to a string of coil tubing or to any tool that may be located below the down jar mechanism.

The upper portion of the housing incorporates an internal compressive load delivery system that may be generally referred to as an inverted accelerator. The tubular housing section 18 defines an internal spring chamber 58 within which is located a compression spring system 60. The compression spring system will typically incorporate a spring stack of suitable height which is defined by a plurality of Belleville springs 62. The lower end of the compression spring system is supported by a force transmission washer 64 which bears against an upwardly directed thrust shoulder 66 formed by the upper end of the housing spacer 18. The upper end of the compression spring system 60 bears against a thrust washer 68 which in turn bears against a downwardly directed thrust shoulder 70 of the mandrel 40. The compression spring system is maintained in alignment by means of a tubular spring guide element 72 which is threadedly connected at 74 within the lower end of the upper mandrel 44. At the maximum expanded condition of the compression spring system, the lower end of the tubular spring guide 72 will be located within the upper end of an internal alignment passage 76 of the housing spacer 18. Thus, at all positions of the telescoping upper mandrel 44 the compression system remains adequately guided and centered by the tubular spring guide 72.

In order to permit the passage of fluid through the down jar mechanism to provide for continued circulation of fluid into the well during jarring activities, the top sub 46 is provided with a flow passage 78 that is in communication with a flow passage 80 of the mandrel 44 and a flow passage 82 of the tubular spring guide 72. Additionally, it should be born in mind that the alignment passage 76 of the housing spacer 18 also functions as a flow passage to facilitate circulation of fluid through the jar mechanism.

The mechanical down jar mechanism defines a load delivery system for jarring with significant force and also defines a latch mechanism or firing mechanism for releasing the sudden downwardly directed load delivery system when a predetermined downward force has been applied to the apparatus. The intermediate housing section 20 forms an internal spring chamber 84 within which is received a compression spring assembly 86 which will preferably incorporate a plurality of Belleville springs 88 having the capability of storing sufficient mechanical energy to deliver the load of the jarring mechanism. Hence, the compression spring assembly 86 is also referred to herein as the load spring.

Figure 4:
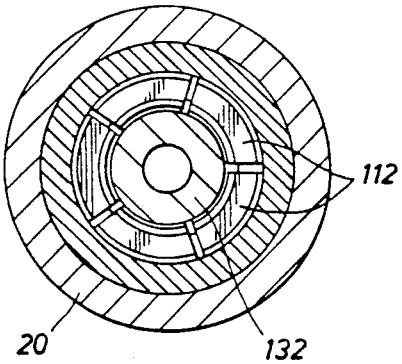
Figure 5:
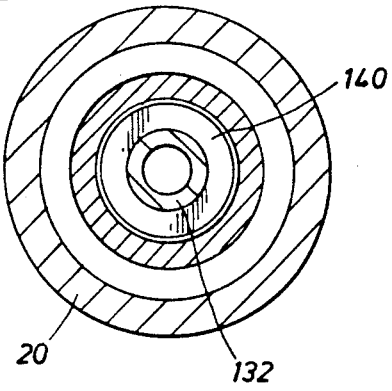

The upper end of the compression spring assembly 86 bears against a spacer thrust washer 90 which in turn engages an internal thrust shoulder 92 defined by the lower end of the housing spacer 18. At this point, it should be noted that the compression spring assembly incorporates heavy-duty Belleville springs along most of its length and employs lighter weight Belleville springs at its upper extremity. This feature ensures that the compression spring assembly is capable of delivering sufficient force for efficient down jarring activity of high magnitude and also insures that the firing mechanism of the apparatus will have ample linear movement for efficiency of control and firing. The lower end of the compression spring assembly engages a lower thrust washer 94 which is seated against a circular thrust shoulder 96 formed by a circular enlargement 98 at the upper end of a tubular upper spacer 100. The outer cylindrical surface of the upper spacer 100 is received in close fitting relation guided within a cylindrical bore 102 defined by tubular detent body 104. The detent body thus functions as a guide to maintain the upper spacer 100 properly positioned within the housing. The large diameter upper end 98 of the upper spacer 100 also defines a circular outer peripheral surface having guided relation with the inner cylindrical surface 84 of the intermediate housing section 20. The firing mechanism of the mechanical down jar apparatus also incorporates a lower tubular spacer member 108 which is also disposed for linear movement within the intermediate housing section and is positioned and guided by the inner cylindrical surface 102 of the detent body 104. A firing lug assembly 110 which, as shown in FIG. 4, is composed of a plurality of firing lug segments 112, is positioned between the lower end of the upper spacer member 100 and the upper end of the lower spacer member 108. The upper and lower spacers cooperate to secure the firing lug segments 112 against linear movement except as permitted by simultaneous movement thereof along with the upper and lower spacer members.

The lower spacer member 108 is urged against the firing lug assembly 110 by means of a recock compression spring 114, as shown in FIGS. 1B and 1C, which is maintained within a spring chamber 116. The upper end of the compression spring 114, which is typically a coil spring, bears against a thrust washer 118 seated at the lower end of the lower spacer 108. The lower end of the recock spring 114 bears against a thrust washer 120 which is supported by a circular thrust shoulder 122 forming the lower end of the spring chamber.

The firing lug assembly 110 is normally provided with external support against outward radial movement by means of a circular support land 124 which is formed by the cylindrical surface 102 being intersected by a circular, internal firing detent groove 126 and a circular internal recocking groove 128. Each of the circular grooves 126 and 128 define upper and lower tapered surfaces which establish a camming relationship between the firing ring and the firing lug assembly which, in response to a linear load, imparts radially outward force movements to each of the firing lugs. While the respective firing and recocking grooves permit radial expansion of the firing lug assembly when the spacers 100 and 108 are sufficiently moved in linear manner, the tapered groove shoulders function to achieve radial contraction of the firing lug assembly as the upper and lower spacers shift the firing lug assembly from the respective firing or recocking groove to the support land 124. These features are especially evident in FIGS. 8-11.

Figure 2A:
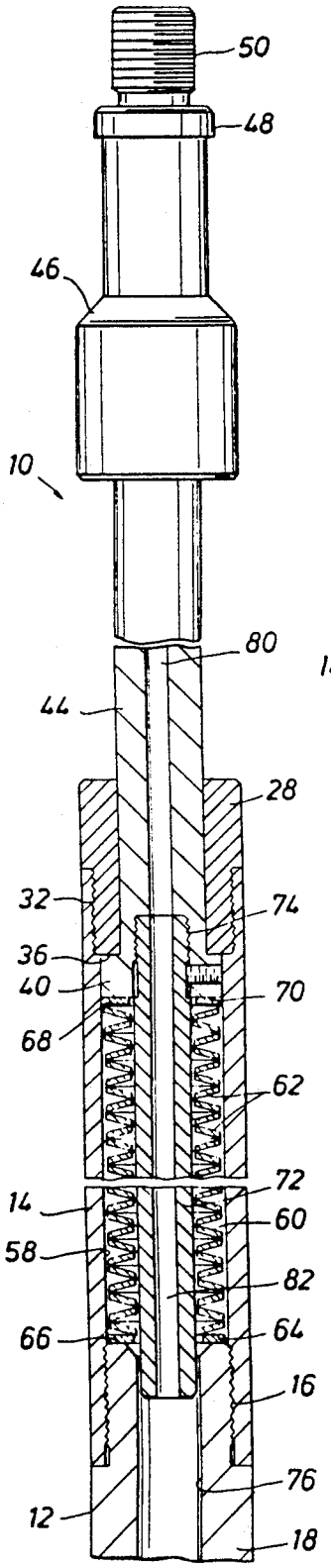
Figure 2B:
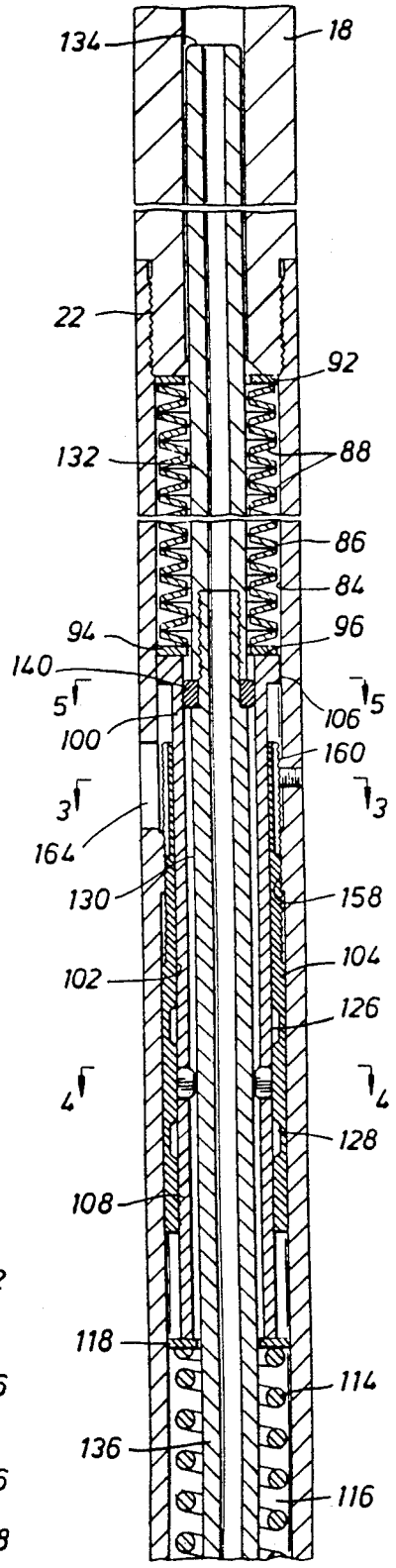

When in position, the respective firing lug segments 112 tend to remain in assembly by virtue of their wedge-shaped configuration as shown in FIG. 4. They can only contract radially inwardly sufficiently that their tapered side surfaces come into contact. When the firing lug assembly is restrained against radially outward movement by the circular support land 124, they are also restrained against excessive radially inward movement by the cylindrical outer surface 130 of a spring guide member 132 as shown in FIGS. 1B and 2B. The spring guide is of sufficient length that its free extremity 134 is positioned within the cylindrical passage 176 of the housing spacer 18 even when the compression spring assembly 86 has expanded to its maximum length. The spring guide member 132 is secured by a threaded connection 134 to an elongate firing ring positioning element 136 and functions to provide a circular locking shoulder 138 at the lower end thereof that secures a circular firing ring 140 in locked position against a circular, upwardly facing shoulder 142 of the firing ring positioner. The firing ring 140 is thus secured in fixed relation with the spring guide element 132 and the firing ring positioning element 136. The firing ring is fixed relative to the lower mandrel 46 so that the housing 12 and the detent body 104 are movable with respect to the firing ring during both the firing and recocking strokes thereof. The upper and lower spacers and the firing lug assembly are also linearly movable relative to the fixed firing ring.

Figure 2C:
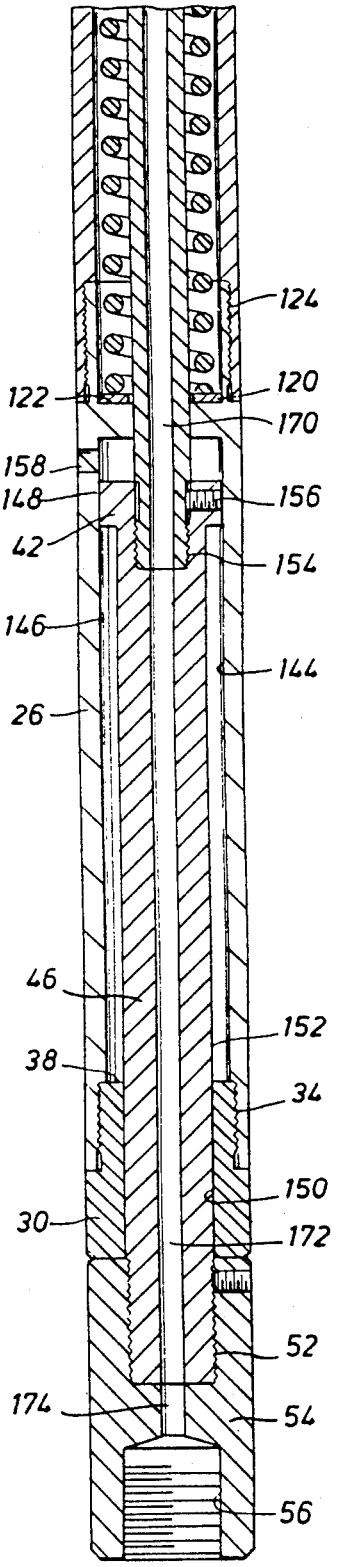

The lower body section 26, as shown in FIGS. 1C and 2C, forms an inner cylindrical surface 144 which defines an elongate chamber 146 within which the upper end of the lower telescoping mandrel 46 is movably received. The circular enlargement 42 at the upper end of the lower mandrel 46 defines an outer cylindrical guide surface 148 having close fitting guiding relation with the inner cylindrical surface 144. The lower mandrel cap 30 also defines an internal cylindrical guide surface 150 having close fitting guided relation with the outer cylindrical surface 152 of the lower mandrel. The housing is thus efficiently guided by the close fit of the lower anvil cap with the cylindrical lower mandrel.

The firing ring positioning mandrel 136 has its lower end fixed to the upper end of the lower mandrel 46 by means of a threaded connection 154. A set screw 156 secures the mandrel 46 and the firing ring positioning mandrel against relative rotation and thereby secures the threaded connection 154 against inadvertent disassembly. The lower housing section 26 is provided with a port 158, as shown in FIGS. 1C and 2C, that allows rapid egress of fluid from within chamber 146 upon firing of the jarring mechanism. This feature prevents any degree of hydraulic resistance from interfering with the force transmitted by the mechanical down jar during jarring activity.

Figure 3:
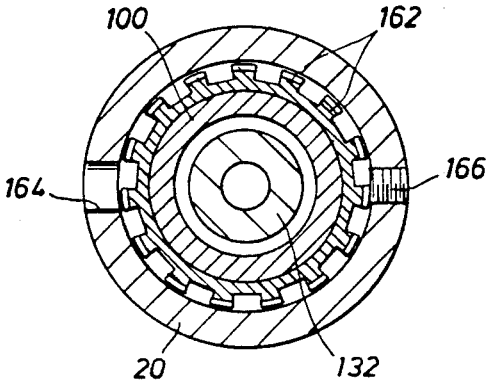

The load of the firing mechanism is adjustable by virtue of relative positioning of the firing groove 126 and the land 124 within the intermediate housing section. To accomplish such adjustment, as shown in FIGS. 1B, 2B and 8-11, the intermediate housing section is provided with an internal detent adjustment thread 158 and the tubular detent body 104 is provided with a mating external adjustment thread 160. As is evident from FIG. 3, the detent body is also provided with a plurality of external longitudinal ridges and grooves or splines 162 that are accessible through a detent positioning port 164. A suitable adjustment tool, such as a screwdriver, pry bar or the like, is inserted through the port 164 and brought into contact with the external splines 162. The tool is used in the nature of a pry bar to apply rotary force to the detent body 104 thus rotating the detent body relative to the internal thread 158 of the intermediate housing section and thus, by virtue of the threaded connection, imparting linear movement to the detent body to adjust its position within the lower body of the down jar and thus alter the spring force that occurs during jarring. The direction of linear detent body movement is of course determined by the direction of rotation of the detent body by the adjustment tool. After the detent body has been properly adjusted, it may be locked in position by means of a set screw 166 or my any other suitable means.

To permit the flow of fluid through the mechanical down jar mechanism, passages 168, 170, 172 and 174 are formed respectively in the spring guide mandrel 132, the firing ring positioning mandrel 136, the bottom telescoping mandrel 46 and the bottom sub 54. These passages form a single straight through flow passage disposed in communication with the passage 76 of the housing spacer and with the flow passage that is cooperatively defined by passages 78, 80 and 82. Thus, fluid can flow at any suitable velocity through the down jar mechanism hereof such as for cleaning the upper end of a stuck object, removing debris that might be covering the stuck object or treating the well bore at a level below the down jar mechanism.

Figure 6:
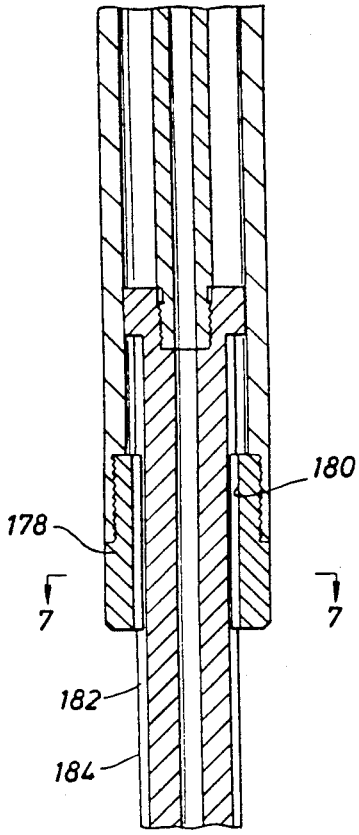

Referring now to FIG. 6, it should be born in mind that the mechanical down jar mechanism of this invention may be equally well suited for use as a snubber or drilling jar by providing appropriate splined interconnection between the housing and the telescoping upper and lower subs so that rotary force may be transmitted through the down jar mechanism to apparatus located below it. As shown in FIG. 6, the housing 176 is provided with a lower anvil cap 178 having internal splines 180 that mate with external splines 182 that are defined by the lower telescoping mandrel 184. Thus, as the housing 176 is rotated, rotational force is transmitted from the lower anvil cap 178 to the lower telescoping mandrel 184 through the splined interconnection therebetween. Although only a splined connection as shown in the bottom of the down jar mechanism of FIG. 6, it is to be born in mind that the upper telescoping mandrel will also have a splined interconnection with the upper anvil cap 28 at the upper portion of the housing structure 12.

OPERATION

In most cases, a coil tubing fishing string consists of (starting from the bottom up) an overshot or spear, an accumulator when used, an up or conventional jar mechanism, a down jar mechanism and an accelerator. When a fish is stuck within the well bore a coil tubing fishing string is utilized to latch onto the fish. After latching has occurred, the up jar is employed to achieve upwardly directed jarring to release and remove the fish from the hole. Repeated jarring may be necessary in order to release the fish from its stuck position to allow it to be retrieved.

In the event upwardly directed jarring can not loosen and retrieve the fish, it will be appropriate to jar in the opposite direction to loosen the fish in the downward direction. Heretofore, downward jarring in connection with coil tubing has not ordinarily been within the capability of fishing equipment.

To accomplish down jarring activity, according to the present invention, the operator will pick up the pipe weight as shown in FIGS. 10 and 11 in order to cock the down jar mechanism. The weight of the pipe is then placed on the tool string as shown by FIGS. 8 and 9. The upper part of the down jar mechanism will move downwardly and start closing and will accomplish storage of energy in the upper portion of the housing. The adjustable latch mechanism within the lower portion of the housing will resist downward movement of the housing relative to the lower mandrel. When stored energy of the Belleville spring 88 overcomes the setting of the latch assembly, the jar mechanism releases and all of the stored energy in the upper body section is released to the outer body. The outer body then travels downwardly at high velocity and strikes the bottom sub 54. This may be repeated by again picking up the pipe weight sufficiently to achieve recocking of the latch mechanism. By again lowering the pipe weight, the down jar mechanism will fire or release as soon as its predetermined load setting is exceeded by the stored energy of the load spring assembly, thereby again jarring the housing against the upwardly directed shoulder of the bottom sub. This can be done as often as necessary. It usually takes three or four down jar strokes to release fishing tools after the fishing tools have been jarred upwardly a number of times.

Assuming that the down jar mechanism is in the cocked position as shown in FIGS. 1A, 1B, and 1C, as the pipe weight is then set down, force is applied to the upper telescoping mandrel 44 to the compression spring system 60, thus collapsing the compression spring system to the degree permitted by the Belleville load spring assembly. The spring guide 72 will therefore be forced more into the internal passage of the housing spacer 18 as is evident in FIG. 1A. The force applied to the compression spring system is translated to the upwardly directed shoulder 66 of the housing spacer 18 and is also translated by the downwardly directed thrust shoulder 92 to the compression spring assembly 86. This downwardly directed force is applied from the compression spring assembly 86 to the spacer and firing lug assembly, as shown in FIGS. 8 and 9, thereby moving the firing lug assembly downwardly until it comes into contact with the firing ring 140. At this point, further downward movement of the firing lug assembly is restrained by the firing ring. Further, by virtue of the tapered interengaging surfaces of the firing lug assembly and the firing ring, a radially outwardly directed force movement is developed on the firing lug assembly which, except for the presence of the supporting land 124, will cause the firing lug assembly to expand radially outwardly. It should be noted that the firing ring 140 will not move under this condition, because of its fixed relation to the firing ring positioning mandrel 136 which is in turn disposed in fixed relation with the fish by virtue of its fixed relationship with the lower telescoping mandrel 46.

As the downwardly directed force continues to increase, the housing will be moving downwardly as permitted by compression of the load spring system 86 and the detent body 104 will be moving downwardly with the housing. Eventually, as the downward force increases, the compression spring assembly 86 will have been loaded with to maximum extent as determined by the releasing or firing setting of the latch mechanism. Downward movement of the housing 12 continues until the firing groove 126 is brought into registry with the firing lug assembly as shown by FIG. 9. When this occurs the individual firing lug segments 112 will then be suddenly moved radially outwardly by virtue of the camming engagement between the tapered surfaces of the firing lug segments and the firing ring. Movement of the firing lug segments 112 into the firing groove 126 will suddenly release the axial restraint of the firing lug assembly and the firing ring, thus releasing the housing to be driven rapidly downwardly under the force of the compression spring assembly 86. The firing lug assembly, because of its radial expansion, will move downwardly past the firing ring as the housing 12 moves rapidly downwardly. Downward housing movement will continue until the lower mandrel cap 30 comes into striking contact with the upwardly directed shoulder of the bottom sub 54. This striking force is controlled by the adjustment setting or releasing force of the firing assembly of the latch mechanism and its compression spring. The springs 86 and 114 will cooperate immediately after firing to return the firing lug assembly to its contracted condition so that it is radially supported by the circular land 124 as shown in FIG. 10.

With the jarring mechanism now in the "fired" position shown in FIGS. 2A, 2B, 2C and FIG. 10 recocking of the firing assembly is achieved by applying an upwardly directed force to the housing 12. At the surface, the operator will lift the pipe weight from the jarring mechanism, thereby imparting an upwardly directed force to the housing 12. When this occurs, the firing lug assembly of the latch mechanism is moved upwardly until it comes into contact with the firing ring 140. Here again, the engagement that takes place between the firing lug assembly and the firing ring imparts a radially directed force as well as a linearly directed force to the firing lug assembly. The linearly directed upward force is translated from the housing to the lower spacer member 108 to the recocking spring 114. As the recocking spring is compressed, the detent body 104 will be moved upwardly relative to the restrained firing lug assembly, thus bringing the recocking groove 128 into registry with the outer periphery of the firing lug assembly as shown in FIG. 11. When this has occurred, the radially directed force applied to the firing lug assembly will suddenly move all of the segments 112 of the firing lug assembly into the recocking groove 128. When this has been accomplished, the firing lug assembly will move past the firing ring 140 as shown in FIGS. 1A, 1B 1C and FIG. 11. Simultaneously, the force of the compression spring 114, acting upon the lower spacer 108, will immediately shift the firing lug assembly to its restrained position in relation to the cylindrical surface 124 defined by the internal land of the detent body. In this condition, the apparatus is again ready for another down jarring stroke. As mentioned above, down jarring may be continued repetitively as long as desirable without causing damage or deterioration to the jarring mechanism. The down jar mechanism will make coil tubing, fishing and releasing, equal to wireline releasing tools. However, coil tubing can pull 10–11 times more than typical wireline retrieving systems. Additionally, fluid may be circulated through the down jar mechanism which is a significant advantage over conventional down jarring devices.

The compression spring system 60 will function in the nature of an inverted accelerator to enhance the jarring activity that takes place. As downward force is applied through the upper telescoping mandrel, the compression spring system 60 is compressed so that the downward force applied to it is transmitted to the housing 12. When release or firing of the latch mechanism occurs, the compression spring induces additional downward impetus to the housing. Since the compression spring assembly 160 is of lighter compressive weight, the spring system 60 induces delayed downward impetus to the housing, thus lengthening the duration of the downward shock pulse of the down jar mechanism against the object to be moved. This feature enhances use of the down jar for achieving insertion of coil tubing into deviated or horizontal well bores.

Figure 7:
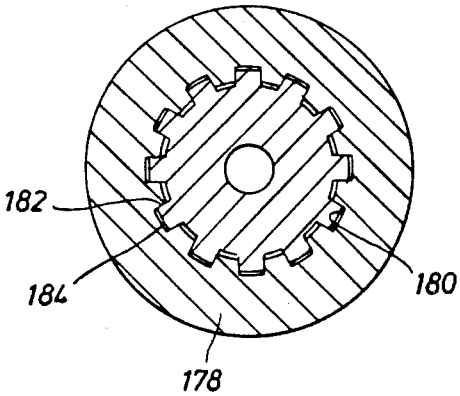

The down jar mechanism is not limited to running with fishing tools on coil tubing. It may be run to release locking mandrels, broaching tools, shear pins and may also be employed to jar down to free a fish from its stuck position within a well bore. Further, mechanism may be used in connection with one or more other down jars and it may also be employed in conjunction with up jar mechanisms. The apparatus may also be employed for drilling and snubbing activities, assuming that it incorporates splined connections as shown in FIGS. 6, 7 and 13.

The recocking down jar mechanism of FIGS. 1A-2C will be capable of hydraulic recocking if sufficient fluid pressure is introduced, such as by a pump located at the surface, into the circulation passage 80 so as to develop a recocking force that is capable of telescopically extending the mandrel to its recocking position. The pump injected fluid pressure within the fluid circulation passage will act upon the upwardly directed surface 134 of the spring guide and firing ring positioner 136. In this case surface 134 becomes a pressure responsive area. If pressure acting on the pressure responsive area, together with linear friction of fluid flowing downwardly at high pressure in the circulating passage develops a sufficient downwardly directed force on the lower mandrel 46, it will be telescopically extended to the recocking position shown in FIG. 1C. At this position the recocking mechanism will assume the condition shown in FIGS. 1A-1C. Thus the recocking mechanism is capable of functioning either mechanically or hydraulically or both.

Referring now to FIGS. 12 and 13, a down jar mechanism representing an alternative embodiment of the present invention may be provided with a facility for accomplishing hydraulic recocking, either in lieu of, or in combination with the mechanical recocking system. For purposes of simplicity, as shown in FIGS. 12-14, only a portion of the down jar mechanism is illustrated because the internal components thereof may be substantially identical whether mechanical or hydraulic recocking is employed. The hydraulic recocking down jar is shown in FIG. 12 in its fired condition after having delivered a downwardly directed shock force to a fish or tool that is connected beneath it.

In FIG. 13 the hydraulically recocked down jar mechanism is shown in its cocked position ready to telescopically collapse and transfer a downwardly directed shock force to a fish or tool that is coupled to its lowermost threaded connection. The lower housing section 151 of the down jar mechanism illustrated generally at 150 is provided with a lower anvil cap 152 that may be identical with the anvil cap 30 shown in FIG. 1C. The anvil cap 152 forms a downwardly directed shoulder 154 that is oriented to strike and impart a downwardly directed force to an upwardly facing shoulder 156 of a bottom sub 158. The bottom sub is provided with an elongate mandrel 160 that may be provided with external splines 162 and which is received in telescoping relating within the lower housing 151 of the down jar mechanism. The mandrel 160 defines a circulating passage 164 through which fluid is circulated while the jarring string is located in the well bore.

A hydraulic recocking sub 166 is threadedly connected to the lower end of the bottom sub 158 and forms a fluid circulation passage 168 of essentially the same dimension as the circulation passage 164 of the mandrel 160. Extending downwardly from the passage 168 is a reduced diameter fluid circulation passage 170. At the intersection of passages 168 and 170 there is formed an internal, upwardly directed, shoulder 172 forming a differential area against which fluid pressure in passage 168 is operative to develop a downwardly directed resultant force acting to urge the mandrel 160 downwardly. The magnitude of this downwardly directed pressure responsive force is determined by the pressure within the passage 168 and the pressure responsive area defined by the shoulder 172.

When the down jar mechanism of FIGS. 12 and 13 has fired and has rapidly collapsed to the position shown in FIG. 12, thereby delivering a downwardly directed shock force from the anvil cap 152 to the bottom sub or anvil 158, and thus delivering a downwardly directed shock force from the down jar to the fish or other object that is secured to the threaded connection 174 it will be necessary to recock the latching mechanism of the down jar for subsequent down jarring. To recock the down jar mechanism, hydraulic pressure introduced by a pump or from any other suitable force is provided in the circulation passage 164. Because of the restricted circulation passage 170 of the hydraulic recocking sub, a pressure increase is developed in the circulation passage 168 to a pressure level that is determined by the discharge of the pump. For example, a pressure in the range of 1400 pounds to 2000 pounds in the circulating passage 168 will provide sufficient force against the upwardly directed pressure responsive surface 172 to extend the mandrel 160 to the recocked position as shown in FIG. 13. Thus, by adding a recocking sub with a circulating passage of reduced dimension as shown at 170, hydraulic linear friction can be built up within the circulating passage and can develop a downwardly directed force on the hydraulic recocking sub to overcome internal spring force and shift the jar mechanism from the fired condition shown in FIG. 12 to the recocked condition shown in FIG. 13, assuming that the downward force of the jarring or fishing string has been eliminated by picking up the fishing string. Thus, hydraulic recocking occurs upon picking up the fishing string at the same time that pressure is introduced into the circulating passage 164-168 by a pump or other pressure source located at the surface. It will be observed that termination or reduction of high pressure fluid circulation will allow fluid pressure in the circulation passage to deplete as it flows through the restricted flow passage 170.

It should be born in mind that the hydraulic recocking mechanism may take forms other than that shown in the drawings. For example, a small lower splined mandrel may be provided having enough length to produce sufficient linear friction to accomplish recocking of the down jar if sufficient differential pressure is developed to produce a recocking force of sufficient magnitude.

As illustrated in FIG. 14, a down jar mechanism, such as that set forth above may be provided with a blind box for use at the lower extremity of the jar mechanism and which is capable of applying a downwardly directed jarring force to a fish or other object without being threadedly connected to the object. As shown in FIG. 14 the hydraulic recocking sub 166 is provided with a blind box 176 having a circulating passage 178 that is in registry with the circulating passage 170. The blind box is provided with an internal threaded connection 180 that receives the downwardly directed external threaded connection 174. The blind box 176 functions as an anvil having a lower downwardly directed shoulder 182 which imparts shock forces to the fish or other downhole object upon firing of the jar mechanism.

Ordinarily, mechanical jar mechanisms are recocked by moving the fishing string upwardly so as to impart an upwardly directed force that telescopically extends the jar mechanism to its recocked position. Obviously, when a blind box is utilized as shown in FIG. 10 an upwardly directed force on the down jar mechanism would not accomplish mechanical recocking. Therefore, with the weight of the fishing string relieved and by building up sufficient pressure in the circulating passage 168 to develop a downwardly directed resultant force on the shoulder 172, the hydraulic recocking sub 166 and the mandrel to which it is readily connected will be moved downwardly to recock the down jar mechanism. Thus, even with the use of a blind box at the lower end of the down jar, hydraulic recocking can be efficiently accomplished for repeatedly jarring downwardly on a fish or other stuck object.

In view of the foregoing, it is evident that the present invention is one well adapted t o attain all of the objects and features hereinabove set forth, together with other objects and features which are inherent in the apparatus disclosed herein.

As will be readily apparent to those skilled in the art, the present invention may be produced in other specific forms without departing from its spirit or essential characteristics. The present embodiment, is therefore, to be considered as illustrative and not restrictive, the scope of the invention being indicated by the claims rather than the foregoing description, and all changes which come within the meaning and range of the equivalence of the claims are therefore intended to be embraced therein.

What is claimed is:

1. A hydraulically recocking mechanical down jar mechanism for freeing stuck objects within a well bore and for conducting other downhole activities, comprising:

(a) an elongate tubular housing for connection to a jarring string and forming an anvil;

(b) a mandrel being disposed in telescoping relation with said anvil and said elongate tubular housing, and being telescopically movable to an extended position for recocking and a contracted position for downward jarring, said mandrel adapted to be struck by said anvil upon rapid jarring movement of said elongate tubular housing from said extended position to said contracted position to impart a downwardly directed jarring force to an object located within said well bore, said mandrel forming a circulating passage for passage of fluid therethrough;

(c) said elongate tubular housing having firing and recocking means for cooperative firing and recocking association with said mandrel; and (d) means forming a pressure responsive surface area within said mandrel being exposed to fluid pressure within said circulating passage, whereby upon development of predetermined fluid pressure within said circulating passage a downwardly directed pressure responsive resultant force is developed on said mandrel for urging urge said mandrel from said contracted position to said extended position thereof for recocking said firing and recocking means.

2. The hydraulically recocking mechanical down jar mechanism of claim 1, wherein said mandrel defines a circulating passage section forming a restriction and defining said upwardly directed pressure responsive surface area.

3. The hydraulically recocking mechanical down jar mechanism of claim 2, wherein said pressure responsive surface area is located upstream of said restriction.

4. The hydraulically recocking mechanical down jar mechanism of claim 1, wherein a recocking sub is threadedly connected to the lower end of said mandrel and forms a circulating passage of flow restricting dimension, said recocking sub further defining said upwardly directed pressure responsive area at the upper end of said restricted circulating passage.

5. The hydraulically recocking mechanical down jar mechanism of claim 4, including a blind box being fixed to the lower end of said recocking sub and defining an impact shoulder for transmitting downwardly directed impact forces to an object within said well bore.

6. A hydraulically recocking mechanical down jar mechanism for freeing stuck objects within a well bore and for conducting other downhole activities, comprising:

(a) an elongate tubular housing for connection to a jarring string and forming an anvil;

(b) a mandrel being disposed in telescoping relation with said anvil and said elongate tubular housing, and being telescopically movable to an extended position for recocking and a contracted position for downward jarring, said mandrel adapted to be struck by said anvil to impart a downwardly directed jarring force to an object located within said well bore, said mandrel forming a circulating passage for passage of fluid therethrough;

(c) said elongate tubular housing having a firing and recocking mechanism releasing said mandrel for telescopic contraction and downward jarring upon application of predetermined downward force to said elongate tubular housing and recocking said firing mechanism upon predetermined telescopic extension of said mandrel relative to said elongate tubular housing; and (d) means forming an upwardly directed pressure responsive area within said mandrel and exposed to fluid pressure within said circulating passage, whereby upon development of predetermined fluid pressure within said circulating passage a downwardly directed pressure responsive resultant force is developed on said mandrel for urging said mandrel from said contracted position subsequent to firing and downward jarring to said telescopically extended position thereof for recocking.

7. The hydraulically recocking mechanical down jar mechanism of claim 6, wherein said mandrel defines a circulating passage section forming a restriction and defining said upwardly directed pressure responsive surface area.

8. The hydraulically recocking mechanical down jar mechanism of claim 7, wherein said pressure responsive surface area is located upstream of said restriction.

9. The hydraulically recocking mechanical down jar mechanism of claim 6, wherein a recocking sub is threadedly connected to the lower end of said mandrel and forms a circulating passage of flow restricting dimension, said recocking sub further defining said upwardly directed pressure responsive area at the upper end of said restricted circulating passage.

10. The hydraulically recocking mechanical down jar mechanism of claim 9, including:

a blind box being fixed to the lower end of said recocking sub and defining an impact shoulder for transmitting downwardly directed impact forces to an object within said well bore.

* * * * *